US010988367B2

(12) United States Patent
Hagleitner

(10) Patent No.: US 10,988,367 B2
(45) Date of Patent: Apr. 27, 2021

(54) CONTAINER AND CLOSURE ELEMENT INSERTABLE INTO A CONTAINER OPENING

(71) Applicant: Hans Georg Hagleitner, Zell am See (AT)

(72) Inventor: Hans Georg Hagleitner, Zell am See (AT)

( * ) Notice: Subject to any disclaimer, the term of this patent is extended or adjusted under 35 U.S.C. 154(b) by 62 days.

(21) Appl. No.: 16/417,959

(22) Filed: May 21, 2019

(65) Prior Publication Data

US 2019/0270631 A1 Sep. 5, 2019

Related U.S. Application Data

(63) Continuation of application No. PCT/AT2017/060301, filed on Nov. 10, 2017.

(30) Foreign Application Priority Data

Nov. 21, 2016 (AT) ..... 51053/2016

(51) Int. Cl.
*B65D 47/24* (2006.01)
*B67D 3/02* (2006.01)
*B65D 83/00* (2006.01)

(52) U.S. Cl.
CPC ..... *B67D 3/02* (2013.01); *B65D 47/248* (2013.01); *B65D 83/0038* (2013.01)

(58) Field of Classification Search
CPC .... B67D 3/02; B65D 47/248; B65D 83/0038; B65D 7/0294; B65D 3/046; A47K 5/12; A47K 5/1207; A47K 5/13; A47K 5/1214
See application file for complete search history.

(56) References Cited

U.S. PATENT DOCUMENTS

| | | | |
|---|---|---|---|
| 4,823,991 | A | 4/1989 | Skorka |
| 5,115,980 | A | 5/1992 | Skorka |
| 5,975,369 | A | 11/1999 | Yurkewicz et al. |
| 6,695,176 | B1 | 2/2004 | Nazari |
| 7,240,811 | B2 | 7/2007 | Roser |
| 7,395,949 | B2 | 7/2008 | Ehret et al. |
| 7,441,570 | B2 | 10/2008 | Hagleitner |
| 8,360,286 | B2 | 1/2013 | Shi et al. |
| 8,544,692 | B2 | 10/2013 | Rusch et al. |

(Continued)

FOREIGN PATENT DOCUMENTS

| | | |
|---|---|---|
| CL | 199801237 | 2/1999 |
| CL | 200202658 | 10/2003 |

(Continued)

*Primary Examiner* — Jason K Niesz
(74) *Attorney, Agent, or Firm* — Laurence A. Greenberg; Werner H. Sterner; Ralph E. Locher

(57) ABSTRACT

A closure element to be inserted into a container opening includes a cylinder having at least one lateral opening and a piston displaceable and sealed in the cylinder. In a starting position, the piston prevents the discharge of a flowable medium out of the container. The piston diameter is larger than the cylinder diameter and the cylinder is adapted to be elastically expandable at least in a region corresponding to a displacement length of the piston. A container which is filled with a flowable medium and which is provided with a closure element is also provided.

9 Claims, 6 Drawing Sheets

(56) References Cited

U.S. PATENT DOCUMENTS

| | | | | |
|---|---|---|---|---|
| 8,752,595 | B2 * | 6/2014 | Marini | B29C 73/025 141/38 |
| 9,365,408 | B2 | 1/2016 | Tu | |
| 9,802,808 | B2 | 10/2017 | O'Dougherty et al. | |
| 10,259,003 | B2 | 4/2019 | Dhir | |
| 2002/0139816 | A1 | 10/2002 | Powling | |
| 2007/0194045 | A1 | 8/2007 | Py et al. | |
| 2008/0041809 | A1 | 2/2008 | Shek | |
| 2009/0235924 | A1 | 9/2009 | Holakovsky et al. | |
| 2010/0108670 | A1 | 5/2010 | Perry et al. | |
| 2010/0163509 | A1 | 7/2010 | Canziani Hoffa et al. | |
| 2013/0315028 | A1 | 11/2013 | Smith | |

FOREIGN PATENT DOCUMENTS

| | | | |
|---|---|---|---|
| CL | 200301569 | | 8/2004 |
| CL | 201403097 | | 3/2015 |
| CN | 200971208 | Y | 11/2007 |
| CN | 101769382 | A | 7/2010 |
| CN | 102307792 | A | 1/2012 |
| CO | 92304263 | | 10/1989 |
| CO | 98044899 | | 6/1999 |
| CO | 5121319 | U1 | 1/2002 |
| CO | 20050121721 | U2 | 2/2006 |
| CO | 6170069 | A1 | 6/2010 |
| CO | 6220848 | A2 | 11/2010 |
| DE | 1148487 | B | 5/1963 |
| DE | 4136047 | A1 | 5/1993 |
| DE | 4310084 | A1 | 9/1994 |
| EP | 0199142 | A2 | 10/1986 |
| EP | 1571122 | A1 | 9/2005 |
| EP | 2153908 | A1 | 2/2010 |
| EP | 2275014 | A2 | 1/2011 |
| FR | 1375655 | A | 10/1964 |
| JP | 5339634 | B2 | 11/2013 |
| TW | I429580 | B | 3/2014 |
| WO | 2013171706 | A2 | 11/2013 |
| WO | 2016205408 | A1 | 12/2016 |

* cited by examiner

CONTAINER AND CLOSURE ELEMENT INSERTABLE INTO A CONTAINER OPENING

CROSS-REFERENCE TO RELATED APPLICATION

This is a continuation application, under 35 U.S.C. § 120, of copending International Application PCT/AT2017/060301, filed Nov. 10, 2017, which designated the United States; this application also claims the priority, under 35 U.S.C. § 119, of Austrian Patent Application AT 51053/2016, filed Nov. 21, 2016; the prior applications are herewith incorporated by reference in their entirety.

BACKGROUND OF THE INVENTION

Field of the Invention

The invention relates to a closure element which can be inserted into a container opening and which is provided with a cylinder having at least one lateral opening and a piston which is displaceable and sealed in the cylinder and in a starting position prevents the discharge of a flowable medium out of the container.

A closure element of that kind is known, for example, from European Patent EP 15 71 122, corresponding to U.S. Pat. No. 7,441,570. The piston has an annular groove between two peripheral ridges into which a piston seal in the form of an O-ring is fitted. The container is intended in particular for use in a dispenser, having a container receiving device in which it is fitted upside-down, that is to say with its closure element downwardly. Disposed in the container receiving device is an actuating portion, in particular a plunger or the like, which engages into the closure element and which upon actuation lifts the piston so that the lowermost of at least two openings is opened and medium can flow out of the container. Since the container is not compressible but is stiff, actuation of the actuating portion also opens an upper venting opening through which air can pass into the container.

The most widely varying media which are to be discharged portion-wise by the dispenser, for example cleaning agents, disinfectants, and so forth, which in particular are discharged in concentrated form and are diluted for use, are introduced into such containers. It is self-evident that the container and the closure element are formed of a material which is inert in relation to the medium introduced into the container. Naturally that equally applies to the piston seal being used, for which in most cases a second inert material has to be found.

SUMMARY OF THE INVENTION

It is accordingly an object of the invention to provide a container and a closure element insertable into a container opening, which overcome the hereinafore-mentioned disadvantages of the heretofore-known devices of this general type.

With the foregoing and other objects in view there is provided, in accordance with the invention, a closure element which can be inserted into a container opening and which is provided with a cylinder having at least one lateral opening and a piston which is displaceable and sealed in the cylinder and which in a starting position prevents the discharge of a flowable medium out of the container, the piston diameter is larger than the cylinder diameter and the cylinder is adapted to be elastically expandable at least in a region corresponding to a displacement length of the piston.

In this way it is possible to dispense with a piston seal as a specifically dedicated component since sealing integrity is effected directly by the radial elastic pressure of the cylinder wall against the piston periphery. Upon displacement of the piston the elastically expandable region of the side wall is progressively enlarged in the manner of a wave movement and restored again.

In particular in this structural configuration there is the advantage that the piston and the cylinder can be made from the same material, for example from a polyethylene or polypropylene with a suitably high level of chemical resistance.

If the medium is to be discharged from the container, portion-wise frequent displacement of the piston is necessary until the content thereof is emptied. In this case it is advantageous to provide a return spring in the closure element which urges the piston into the starting position forming the closed position, and is supported in particular against an end of the cylinder.

A preferred configuration provides that the two peripheral ridges in the closed or starting position of the piston are disposed on both sides of the lateral opening of the cylinder. This prevents the medium in the closed starting position from penetrating into the part of the cylinder that accommodates the return spring.

In a further preferred configuration in which air can pass into the container, during the discharge of medium from the container, through the second opening in the side wall, it is provided that a respective pair of peripheral ridges is provided on the piston per opening, the center-to-center spacing of which peripheral ridges corresponds to the center-to-center spacing of the openings. In that way both openings are closed in the starting position and open when the piston is displaced.

Other features which are considered as characteristic for the invention are set forth in the appended claims.

Although the invention is illustrated and described herein as embodied in a container and a closure element insertable into a container opening, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
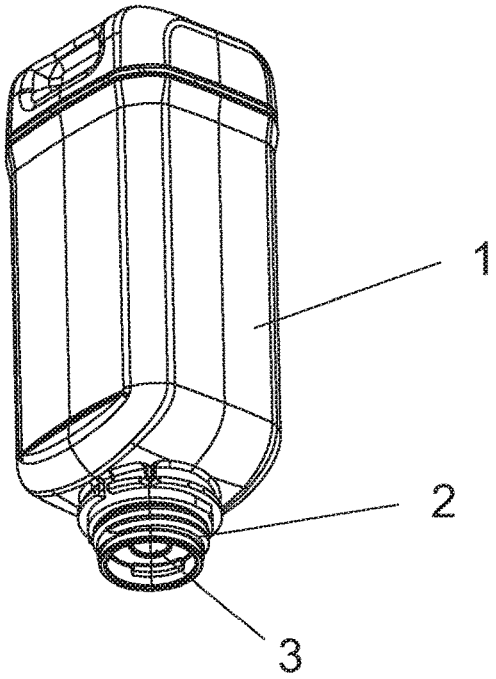
FIG. 1 is a diagrammatic, perspective view of a container as seen from below.

Referring now to the figures of the drawings in detail and first, particularly, to FIG. 1 thereof, there is seen a container 1, into the opening of which a closure element 2 is inserted and usually glued or welded to the container. The container serves to receive a concentrated or diluted flowable medium, for example a cleaning agent, disinfectant or another chemical substance, in which respect that is of significance only insofar as the material of the container and the closure element should not or may not involve any reaction with the content. The container 1 is usually fitted upside-down, that is to say in the position shown in FIG. 1, into a receiving device of a dispenser or a metering device so that the medium can flow out under the effect of the force of gravity when the closure element 2 is opened. For actuation or opening, the closure element 2 is provided with a central recess 3 into which a liftable plunger 20 or the like engages, which is provided in the container receiving device of the dispenser.

Figure 2:
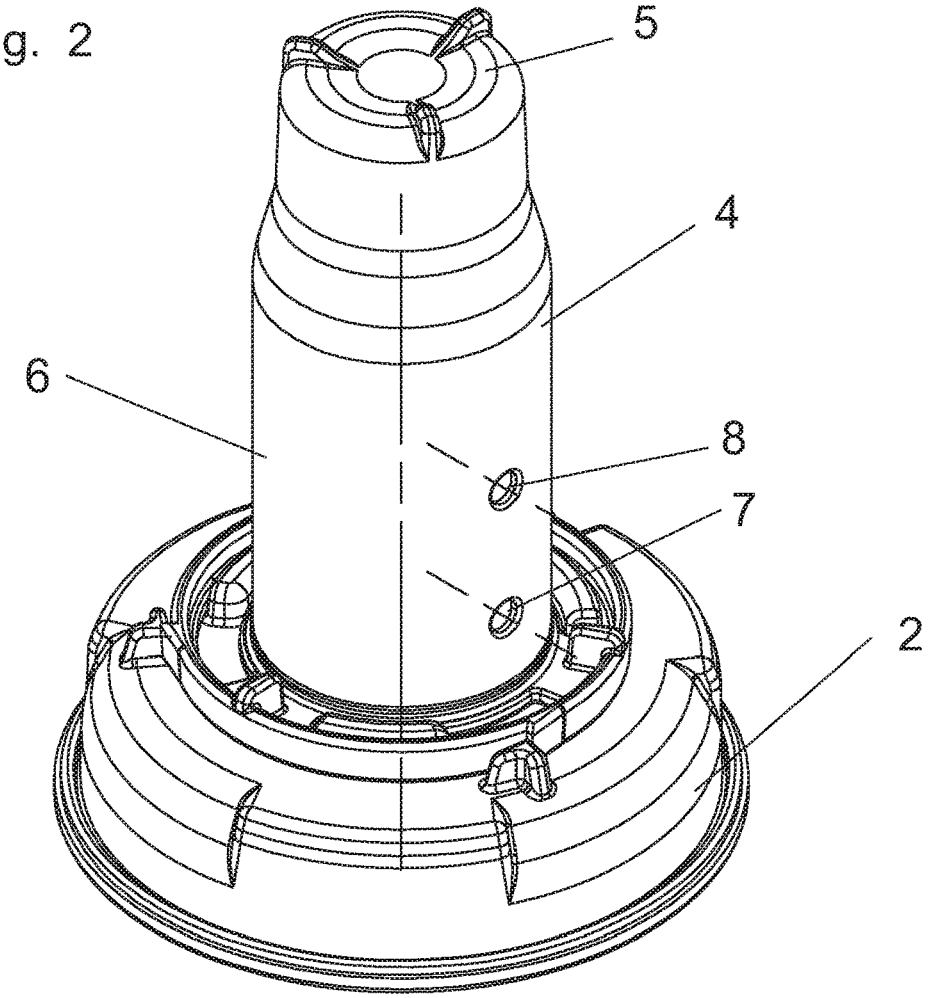
FIG. 2 is a perspective view of a closure element which can be fitted into the container opening.
Figure 3:
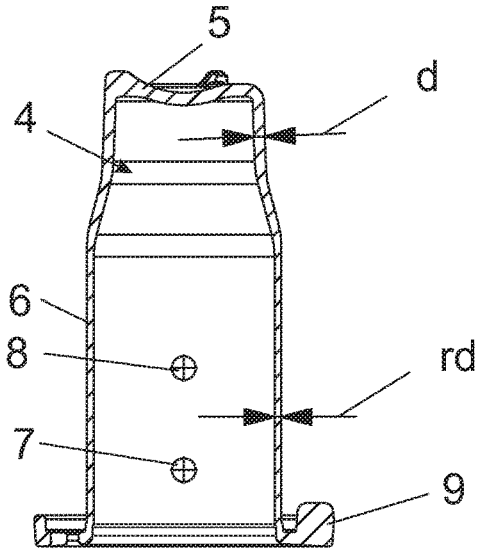
FIG. 3 is a longitudinal-sectional view through the cylinder of the closure element.
Figure 4:
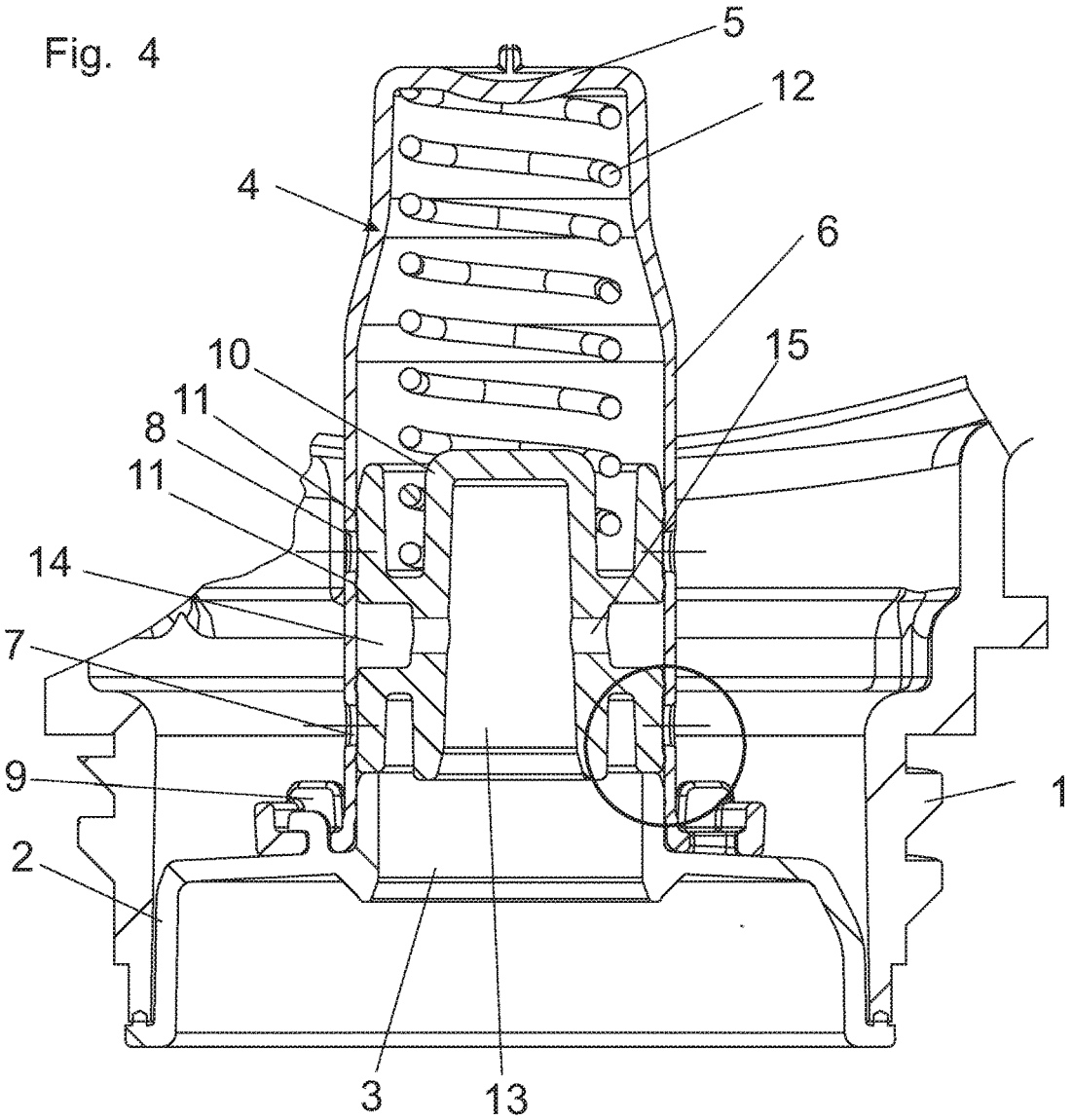
FIG. 4 is a longitudinal-sectional view on an enlarged scale of the starting position of the closure element disposed in the container opening.
Figure 6:
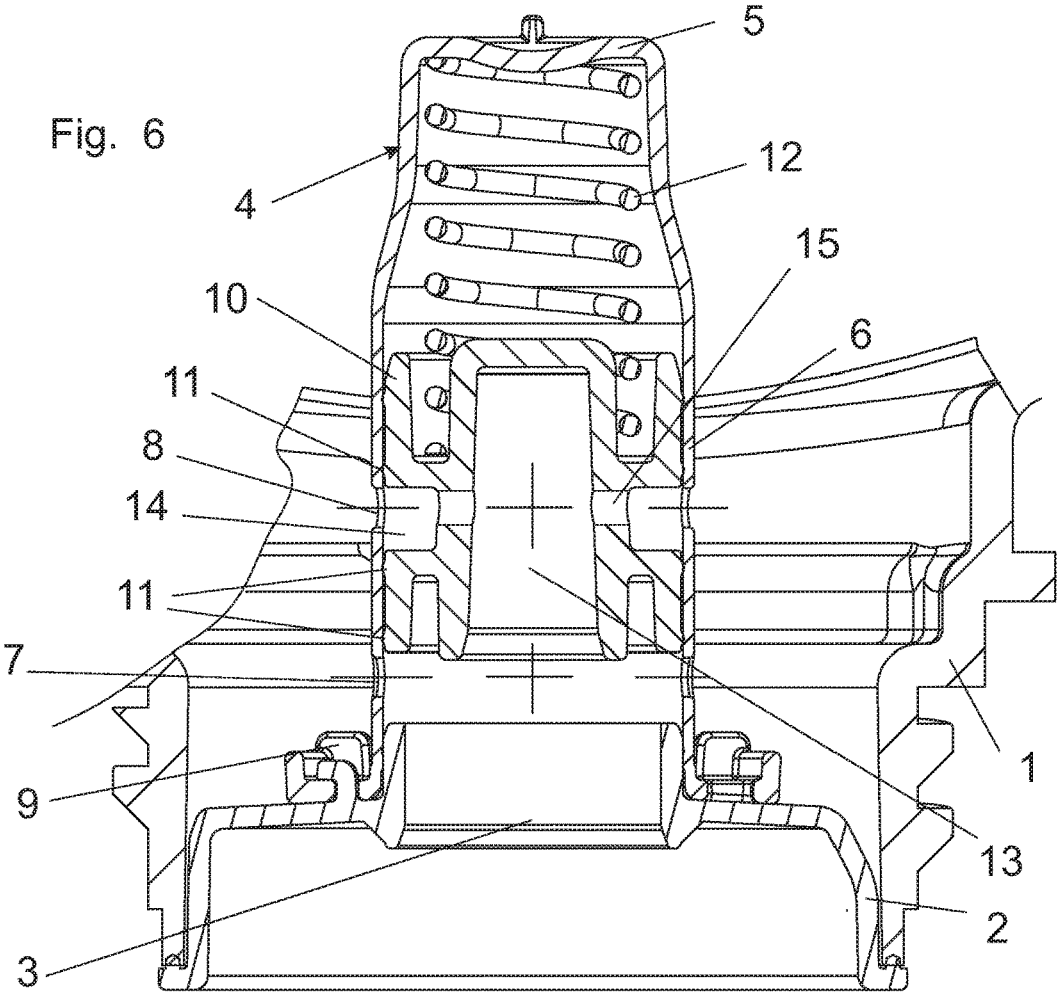
FIG. 6 shows a view corresponding to FIG. 4 with the closure element in the discharge position.

As FIG. 2 shows, the closure element 2 includes a cover-like insert having a cylinder 4 in which a piston 10 is moveable between a closed or starting position shown in FIG. 4 and an open or end position shown in FIG. 6. A lower flange of the cylinder 4 is provided with locking projections 9 for connection to the cover-like insert. That is adjoined by a region 6 in which openings 7 and 8 are provided one above the other. A somewhat narrowing upper portion closes off the cylinder 4 upwardly and is provided with an end 5 serving as a support for a return spring 12 disposed in the interior. As can be seen from FIG. 3, in the narrowing upper portion of the cylinder 4, the wall thickness d is larger than in the region 6 having a thinner wall thickness rd, which is elastically expandable. The number of openings 7 and 8 in the region 6 is any desired number and depends on the nature and property of the flowable medium, that is to say it is also possible to envisage a respective ring of openings 7, 8.

Figure 5:
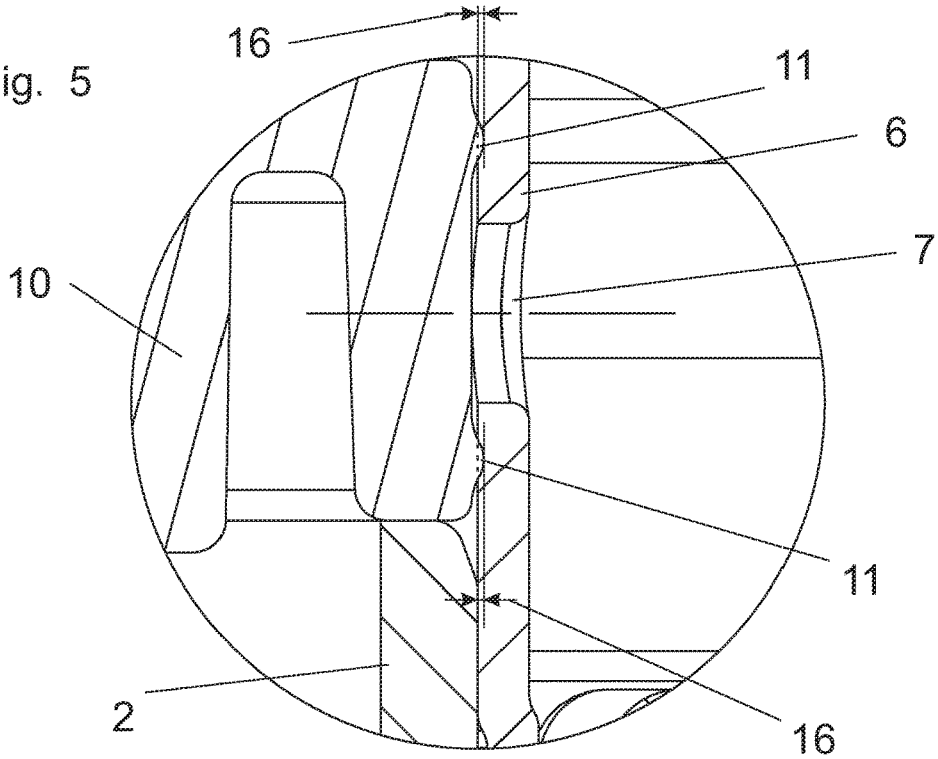
FIG. 5 is a longitudinal-sectional view of a portion shown within a circle in FIG. 4 on a greatly enlarged scale.

The piston 10 disposed in the cylinder 4 has a central, downwardly open recess 13 and a rather central annular groove 14 which is in communication with the recess 13 by way of at least one hole 15. An upper groove serves to receive or support the return spring 12. The two regions above and below the annular groove 14 are respectively provided with a pair of peripheral ridges 11. As measured at each peripheral ridge 11, the outside diameter of the piston 10 is slightly larger than the inside diameter of the region 6 of the cylinder 4. It will be seen from the greatly enlarged portion (FIG. 5) that each peripheral ridge 11 presses into the region 6 of the cylinder wall by an amount 16 governed by the difference in diameters, thereby affording a so-called hard-on-hard seal which makes it unnecessary to provide specifically dedicated sealing rings or the like.

In the starting or closed position shown in FIG. 4 the opening 7 opens between the two peripheral ridges 11 in the lower part of the piston 10 and is thereby sealingly closed off. As the wall thickness rd of the region 6 is substantially reduced, in the lifting movement of the piston 10 each peripheral ridge 11 can be displaced in the region 6 into the discharge position shown in FIG. 4 with wave-like elastic expansion of the region 6 so that the opening 7 is opened and the medium can flow out downwardly under the influence of the force of gravity. The upper pair of peripheral ridges 11, which in the starting position shown in FIG. 4 closes the upper opening 8 in the same manner and there too seals off the container, also opens the upper opening 8 when the piston 10 is lifted into the discharge position as the center-to-center spacing between the pairs of peripheral ridges 11 corresponds to the center-to-center spacing between the openings 7 and 8. With the piston 10 displaced upwardly therefore there is also a flow communication between the opening 8 by way of the annular groove 14 into the central recess 13, by way of which air can flow into the container 1 when a return valve which prevents medium from flowing off through the opening 8 is provided. It can be provided at any suitable location, in particular in the actuating plunger 20 of the dispenser.

Figure 7:
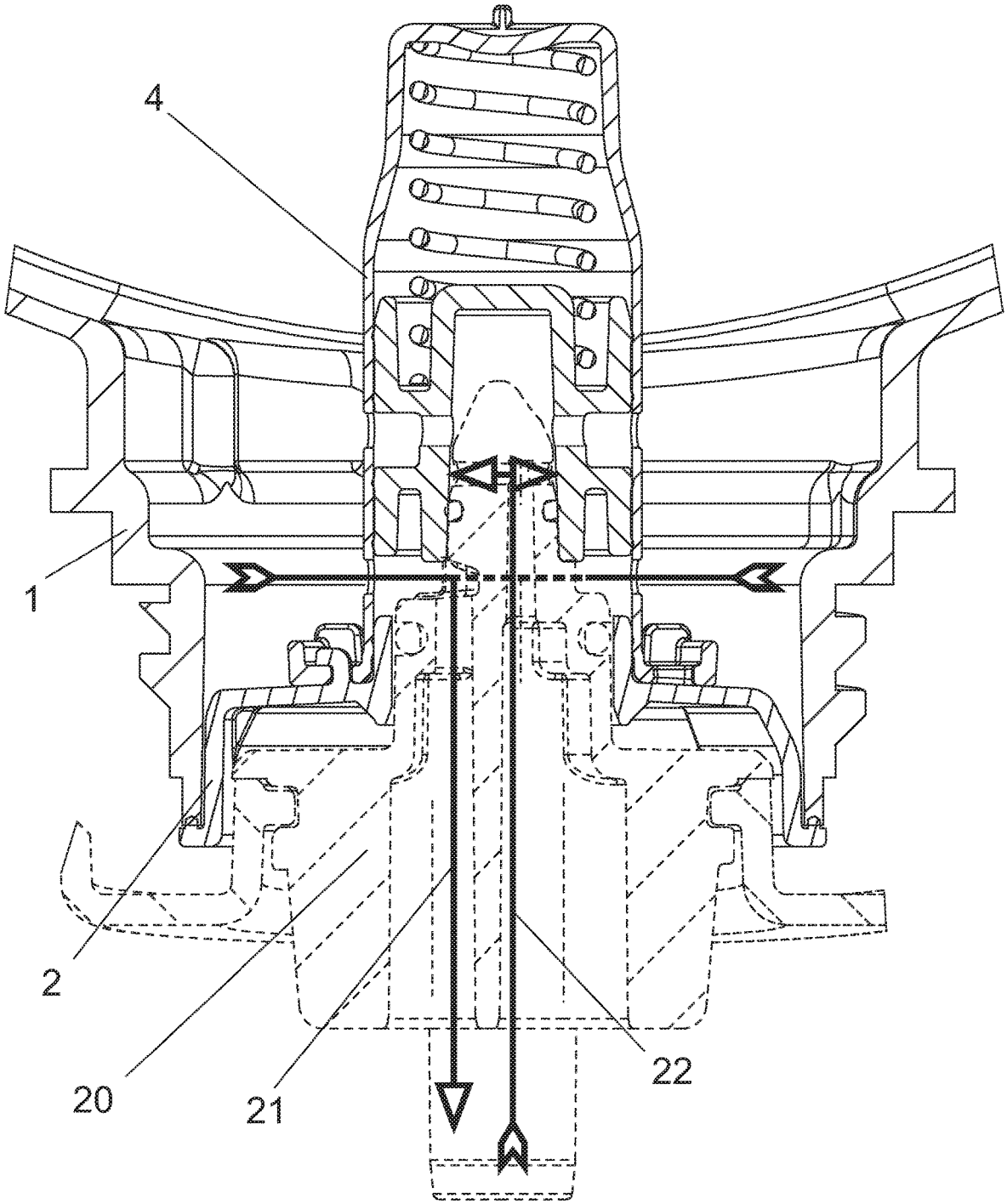
FIGS. 7 through 9 are views corresponding to FIG. 6 in various positions of a liftable plunger and flow paths which are possible therein.
Figure 8:
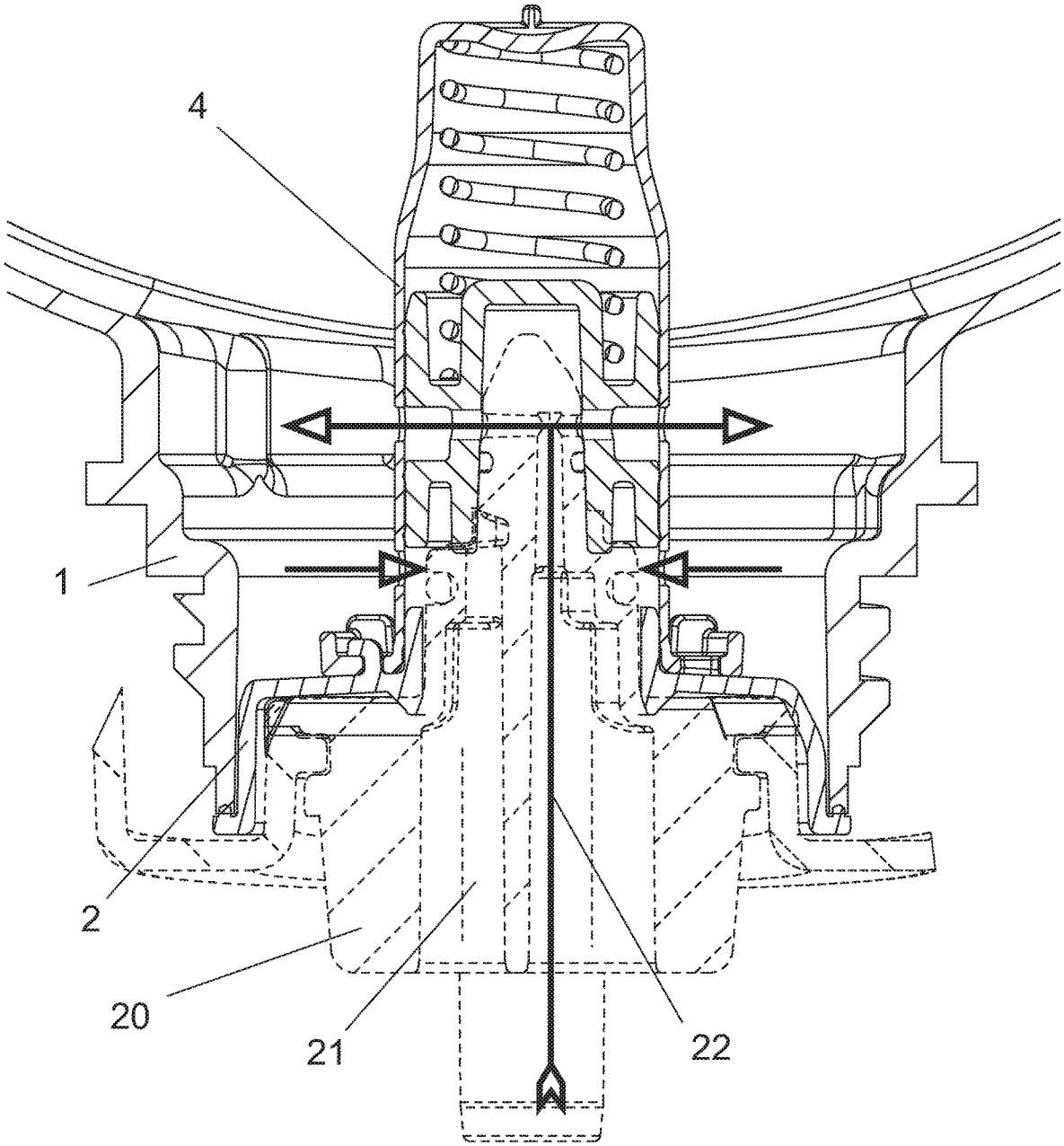
Figure 9:
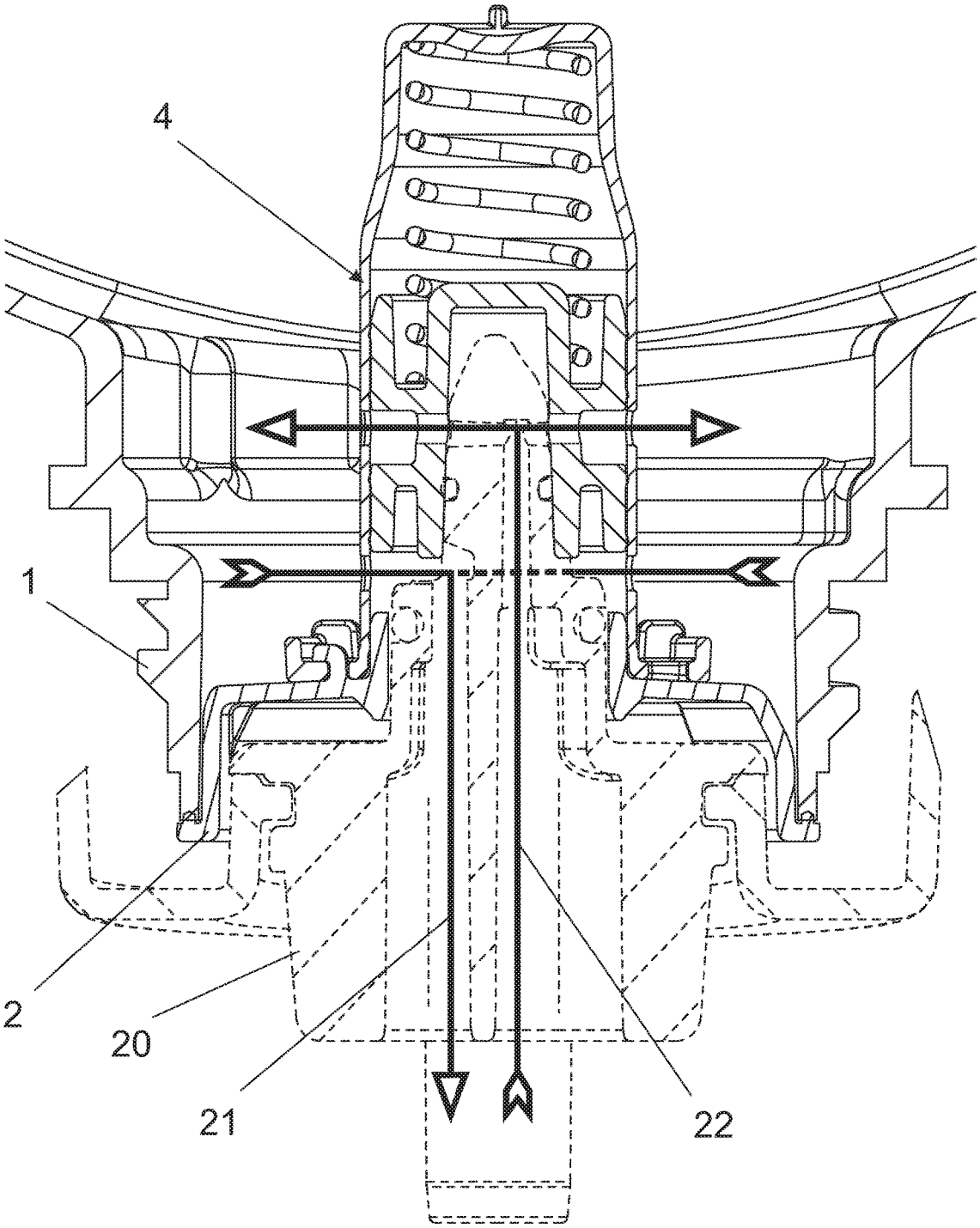

FIGS. 7 through 9 show two embodiments by way of example of an actuating plunger 20 which engages into the central recess 3 of the closure element 2 and includes a fluid passage 21 and an air passage 22 in mutually juxtaposed parallel relationship. In the configuration shown in FIGS. 7 and 8 the lateral outlet openings of the fluid passage 21 and the air passage 22 are disposed at a spacing one above the other, which differs from the center-to-center spacing between the openings 7 and 8. Therefore, after a first stroke movement as shown in FIG. 7 only the communication between the fluid passage 21 and the lateral opening 7 is opened, whereby a given amount of fluid can flow out of the container 1 without air entering and the reduced pressure thus occurring in the container limits the discharge of the medium. When the plunger 20 is lifted further into the position shown in FIG. 8 then the opening 7 is closed and air can flow by way of the air passage 22 and the opening 8 into the container 1 until the reduced pressure is compensated again.

FIG. 9 shows a configuration in which the plunger 20 is longer and the spacing between the lateral outlet openings of the fluid passage 21 and the air passage 22 corresponds to the spacing between the openings 7 and 8 in the expandable region 6 of the cylinder 4. In this embodiment both flow paths are open at the same time in the discharge position of the piston 10, as shown by the arrows in FIG. 9.

After discharge of the desired amount from the container 1 the actuating plunger 20 of the dispenser receiving device is relieved of load and the piston 10 is pushed back by the return spring 12 from the discharge position shown in FIG. 6 into the starting position shown in FIG. 4, in which case the "expansion waves" move back again in the region 6. Materials which are resistant to chemicals like polyethylenes and polypropylenes are sufficiently elastic so that there is no need for sealing elements.

The invention claimed is:

1. A closure element to be inserted into a container opening, the closure element comprising:

a cylinder having a wall, at least one lateral opening and a cylinder diameter;

a piston sealingly displaceable in said cylinder, said piston having a starting position preventing a discharge of a flowable medium out of the container, said piston being displaceable in said cylinder over a displacement length, said piston having a piston diameter being larger than said cylinder diameter and said piston having a periphery; and said cylinder being elastically expandable at least in a region corresponding to said displacement length of said piston, so that a sealing is effected by radial elastic pressure of said wall of said cylinder against said periphery of said piston.

2. The closure element according to claim 1, wherein said cylinder has a side wall with a reduced wall thickness in said elastically expandable region.

3. The closure element according to claim 1, which further comprises a return spring for said piston, said cylinder having an end supporting said return spring.

4. The closure element according to claim 1, wherein said piston has two peripheral ridges, and each of said two peripheral ridges is disposed on a respective side of said at least one lateral opening of said cylinder in said starting position of said piston.

5. A container, comprising:

a flowable medium filling the container; and a closure element according to claim 1.

6. The closure element according to claim 1, wherein:

said at least one lateral opening includes two lateral openings disposed in succession in said displacement direction in said elastically expandable region of said cylinder, said lateral openings being spaced apart by a center-to-center spacing; and said piston includes pairs of peripheral ridges, each of said pairs being associated with a respective one of said openings and having a center-to-center spacing of said pairs of peripheral ridges corresponding to said center-to-center spacing of said lateral openings.

7. The closure element according to claim 6, wherein said piston has a discharge position for withdrawal of the flowable medium from the container, and in said discharge position a fluid passage communicates with one of said openings being closer to said fluid passage in said starting position.

8. The closure element according to claim 7, wherein in said discharge position of said piston an air passage communicates with another of said openings being further away from said fluid passage in said starting position for introducing air into the container.

9. The closure element according to claim 8, which further comprises a plunger configured to be lifted in one or two stages in a container receiving device, said fluid passage and said air passage being formed in said plunger.

* * * * *